US009333390B1

(12) United States Patent
Manwaring et al.

(10) Patent No.: US 9,333,390 B1
(45) Date of Patent: May 10, 2016

(54) GOLF CLUB HEAD WITH ADJUSTABLE CENTER OF GRAVITY AND DIAGNOSTIC FEATURES

(71) Applicant: CALLAWAY GOLF COMPANY, Carlsbad, CA (US)

(72) Inventors: Scott R. Manwaring, Carlsbad, CA (US); James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/446,630

(22) Filed: Jul. 30, 2014

Related U.S. Application Data

(63) Continuation-in-part of application No. 14/180,795, filed on Feb. 14, 2014, now Pat. No. 9,216,332, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/947,903, filed on Mar. 4, 2014, provisional application No. 61/904,383, filed on Nov. 14, 2013, provisional application No. 61/898,956, filed on Nov. 1, 2013, provisional application No. 61/684,079, filed on Aug. 16, 2012, provisional application No. 61/665,203, filed on Jun. 27, 2012.

(51) Int. Cl.

| | |
|---|---|
| ***A63B 53/06*** | (2015.01) |
| ***A63B 24/00*** | (2006.01) |
| ***A63B 53/04*** | (2015.01) |
| ***A63B 69/36*** | (2006.01) |

(52) U.S. Cl.
CPC ..... *A63B 24/0003* (2013.01); *A63B 53/0466* (2013.01); *A63B 69/3632* (2013.01); *A63B 2220/833* (2013.01); *A63B 2243/0029* (2013.01)

(58) Field of Classification Search
CPC ..... A63B 24/0003; A63B 53/0466; A63B 69/3632; A63B 2243/0029; A63B 2220/833; A63B 2053/0491
See application file for complete search history.

(56) References Cited

U.S. PATENT DOCUMENTS

| | | | | |
|---|---|---|---|---|
| 4,811,949 | A * | 3/1989 | Kobayashi | A63B 53/04 473/337 |
| 5,447,309 | A * | 9/1995 | Vincent | A63B 53/04 473/335 |
| 7,771,290 | B2 * | 8/2010 | Bezilla | A63B 53/0466 473/335 |
| 7,824,277 | B2 * | 11/2010 | Bennett | A63B 53/0466 473/328 |
| 7,927,225 | B1 * | 4/2011 | Balardeta | A63B 71/0669 455/73 |
| 8,147,350 | B2 * | 4/2012 | Beach | A63B 53/02 473/307 |
| 8,172,694 | B2 * | 5/2012 | Golden | A63B 24/0003 473/223 |
| 8,414,422 | B2 * | 4/2013 | Peralta | A63B 53/0466 473/334 |
| 8,523,702 | B2 * | 9/2013 | Thomas | A63B 53/0466 473/322 |
| 8,591,352 | B2 * | 11/2013 | Hirano | A63B 53/0466 473/336 |
| 8,992,339 | B2 * | 3/2015 | Matsunaga | A63B 53/04 473/335 |
| 2010/0331102 | A1 * | 12/2010 | Golden | A63B 53/0466 473/337 |
| 2011/0028231 | A1 * | 2/2011 | Balardeta | A63B 24/0021 473/223 |
| 2013/0267339 | A1 * | 10/2013 | Boyd | A63B 69/36 473/223 |
| 2014/0162808 | A1 * | 6/2014 | Stites | A63B 53/06 473/332 |

FOREIGN PATENT DOCUMENTS

| | | | | |
|---|---|---|---|---|
| JP | 2012196241 | A * | 10/2012 | |
| NO | WO 0166199 | A1 * | 9/2001 | A63B 53/04 |

* cited by examiner

*Primary Examiner* — Stephen Blau
(74) *Attorney, Agent, or Firm* — Rebecca Hanovice; Michael Catania; Sonia Lari

(57) ABSTRACT

A golf club head comprising one or more center of gravity adjustment assemblies, and weight cartridges and electronic diagnostic inserts that can be received by said assemblies, is disclosed herein.

10 Claims, 4 Drawing Sheets

GOLF CLUB HEAD WITH ADJUSTABLE CENTER OF GRAVITY AND DIAGNOSTIC FEATURES

CROSS REFERENCES TO RELATED APPLICATIONS

The present application claims priority to 61/947,903, filed on Mar. 4, 2014, and also is a continuation-in-part of Ser. No. 14/180,795, filed on Feb. 14, 2014, which claims priority to U.S. Provisional Patent Application No. 61/904,383, filed on Nov. 14, 2013, and which is a continuation in part of U.S. patent application Ser. No. 14/173,615, filed on Feb. 5, 2014, which claims priority to U.S. Provisional Patent Application No. 61/898,956, filed on Nov. 1, 2013, and also is a continuation in part of U.S. patent application Ser. No. 14/039,102, filed on Sep. 27, 2013, which is a continuation of U.S. patent application Ser. No. 13/797,404, filed on Mar. 12, 2013, which claims priority to U.S. Provisional Patent Application No. 61/684,079, filed on Aug. 16, 2012, and 61/665,203, filed on Jun. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head with adjustable center of gravity assemblies that can be used to adjust the location of the center of gravity as well as to house diagnostic sensors and other electronic measuring equipment.

2. Description of the Related Art

The prior art discloses various designs with center of gravity adjustments to improve golf club performance, but fails to provide a golf club with designs that efficiently alter center of gravity parameters and consequentially enable the golf club to be swung faster along its path and contribute to an improved impact event with the golf ball. The prior art also fails to disclose a golf club head that allows a user to use a center of gravity adjustability assembly to incorporate diagnostic devices into the golf club head to determine what types of changes must be made to the center of gravity parameters to improve a particular golfer's performance.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows a golfer to determine, via diagnostic devices, how best to improve his or her performance, and also allows the golfer to adjust the location, and particularly the height, of the golf club head's center of gravity to achieve that improvement.

BRIEF SUMMARY OF THE INVENTION

The main objective of the present invention is to allow a golfer to analyze his or her golf performance using a particular golf club, and then to improve the location, and particularly the height, of the golf club head's center of gravity. To improve the height of the center of gravity, a golf club head is created which has center of gravity height adjustment assembly. This multiple designs enabling adjustment of the center of gravity can affect the moment of inertia and ultimately the forgiveness of the golf club head. The center of gravity height adjustment assembly also is configured to receive diagnostic devices that allow a golfer to measure certain performance characteristics.

One aspect of the present invention is a golf club comprising a shaft and a golf club head comprising a face component, a body comprising a crown, a sole, a heel side, a toe side, a hollow interior, and a rear side, at least one hollow tube extending through the hollow interior, and a first electronic diagnostic insert sized to fit within the hollow tube, wherein the first electronic diagnostic insert records data about a golfer's swing when a golfer swings the golf club. In a further embodiment, the golf club head may also comprise a weight cartridge sized to fit within the at least one hollow tube, and the first electronic diagnostic insert may be removed from the at least one hollow tube and replaced with the weight cartridge. In another embodiment, the first electronic diagnostic insert may have approximately the same mass as the weight cartridge. In another embodiment, the first electronic diagnostic insert may have a first end comprising a first material and a second end comprising a second material, and the second material may have a higher density than the first material.

In some embodiments, each of the at least one hollow tube, weight cartridge, and first electronic diagnostic insert may have an approximately cylindrical shape. In one embodiment, the at least one hollow tube may extend from the sole to the crown and may be accessible via an opening in the sole. In a further embodiment, the golf club may comprise a removable cover sized to cover the opening in the sole. In another embodiment, the first electronic diagnostic insert may comprise a plurality of sensors encased in a protective shell. In some embodiments, the first electronic diagnostic insert may comprise a removable memory card configured to store the data about a golfer's swing, while in other embodiments, the first electronic diagnostic insert may be capable of connecting to a wireless network.

In a further embodiment, the golf club may comprise a weight port and at least one removable weight screw sized to fit within the weight port. In some embodiments, the golf club head may also comprise a second electronic diagnostic insert, which may be sized to fit within the weight port. In a further embodiment, the second electronic diagnostic insert may have the same shape as the at least one removable weight screw. In another embodiment, the second electronic diagnostic insert may have approximately the same mass as the removable weight screw. In some embodiments, the second electronic diagnostic insert may record data about a golfer's swing when a golfer swings the golf club.

In another embodiment, the golf club head may be selected from the group consisting of a wood-type head, a hybrid-type head, an iron-type head, and a putter-type head. In some embodiments, the at least one hollow tube may extend from a rear edge of the golf club head towards the face component along a horizontal X axis. In another embodiment, the at least one hollow tube may comprise a first hollow tube and a second hollow tube, and the first hollow tube may extend from the crown to the sole. In a further embodiment, the second hollow tube may extend from a rear edge of the golf club head towards the face component along a horizontal X axis. In an alternative embodiment, the first hollow tube may be disposed proximate a heel side of the golf club head, the second hollow tube may extend from the crown to the sole, and the second hollow tube may be disposed proximate a toe side of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
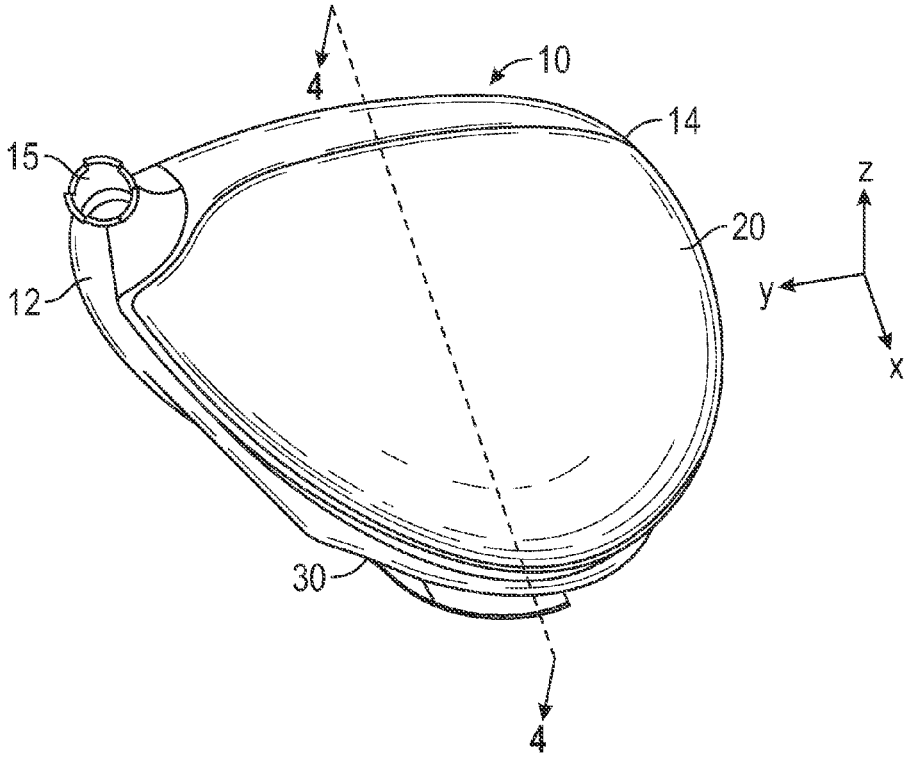
FIG. 1 is a top perspective view of a golf club head according to the present invention.
Figure 2:
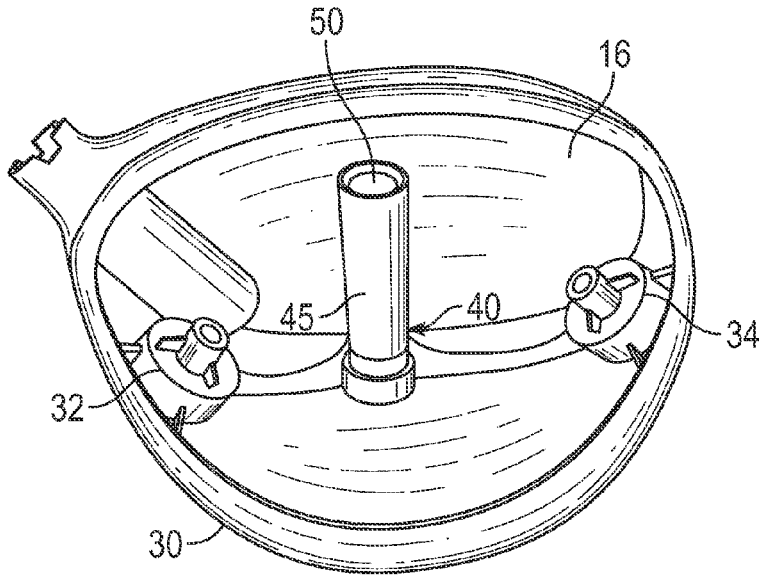
FIG. 2 is a top perspective view of the golf club head shown in FIG. 1 with its crown removed.
Figure 3:
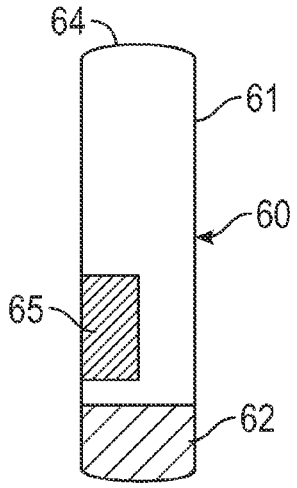
FIG. 3 is a side plan view of an electronic diagnostic insert according to the present invention.

The design approaches described herein are based on the construction used in a driver head characterized by a composite crown adhesively bonded to a cast titanium body, which comprises a face and a sole, and may also comprise a ribbon or skirt portion. However, the embodiments disclosed herein may be used with other golf club head constructions, including but not limited to all titanium, all composite, and a composite body with metal face cup or insert. The diagnostic equipment disclosed herein may be selected from any known to a person of ordinary skill in the art, and in particular can include any of the devices disclosed in U.S. Pat. Nos. 6,638,175, 7,941,097, 7,946,926, 8,120,332, 8,192,293, 8,210,959, 8,272,970, 8,444,499, and 8,446,255, the disclosure of each of which is hereby incorporated by reference in its entirety herein, and U.S. patent application Ser. Nos. 13/707,283, 13/600,629, the disclosure of each of which is hereby incorporated by reference in its entirety herein.

A first, preferred embodiment of the present invention is shown in FIGS. 1-5. In this embodiment, the golf club head 10, which has an adjustable hosel 15, includes a center of gravity height adjustment assembly 40, which preferably is selected from the assemblies disclosed in U.S. patent application Ser. Nos. 13/797,404 and 14/039,102, the disclosure of each of which is hereby incorporated by reference in its entirety herein. The golf club head 10 also includes a pair of weight ports 32, 34, which preferably are disposed in the sole but may, in other embodiments, be located anywhere on the golf club head 10. Most preferably, the center of gravity height adjustment assembly 40 includes a tube 45 that extends from the crown 20 to the sole 30 within the golf club head 10 and a weight cartridge 50 that fits within the tube 45 and can be flipped to adjust the location of the golf club head's center of gravity. The weight cartridge 50 preferably includes a high density end and a low density end to effectuate the change in center of gravity location when the weight cartridge 50 is removed from the tube 45, flipped, and reinserted.

The golf club head 10 also includes an electronic diagnostic insert 60, which is sized to fit within the tube 45 when the weight cartridge 50 is removed. The electronic diagnostic insert 60, shown in FIGS. 3 and 4, records information on a removable memory card 65 about a golfer's swing and/or an impact of the golf club head 10 with a golf ball and, in some embodiments, transmits this information to a receiver via a wireless network to gather information about a golfer's abilities. The electronic diagnostic insert 60 preferably comprises a plurality of electronic components or sensors, including those referenced above, that are encased in a protective shell 61. The memory card 65 can be removed from the electronic diagnostic insert 60 and the information on it can then be analyzed by a computer and/or a coach or fitting instructor to determine how best to improve the golfer's game. The electronic diagnostic insert 60 preferably has the same mass as the weight cartridge 50, with a high density end 62 made of a first material and a low density end 64 made of a second, less dense material so that the electronic diagnostic insert 60 can have the same or identical influence on the location of the golf club head 10 center of gravity as the weight cartridge 50 when it is removed from the tube 45, flipped, and reinserted.

Figure 7:
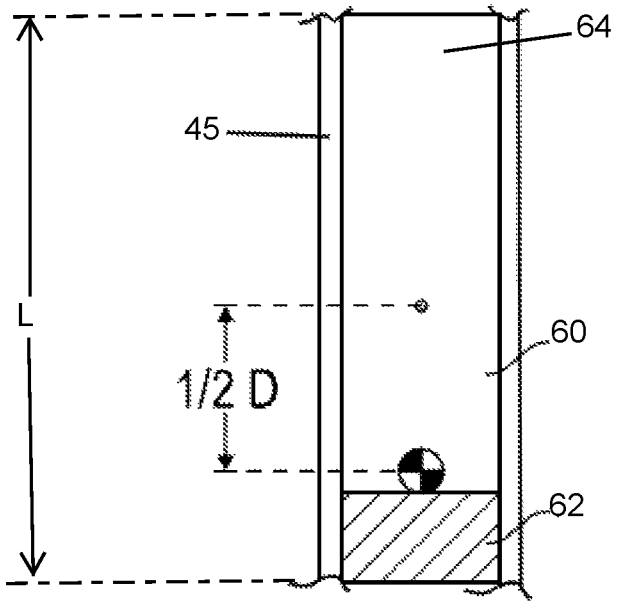
FIG. 7 is a cross-sectional view of a center of gravity height adjustment assembly of the present invention comprising a tube and an electronic diagnostic insert, wherein the distance from the midpoint of the insert to the center of gravity of the insert is shown.

As illustrated in FIG. 7, the preferred design for the golf club head 10 incorporating a center of gravity height adjustment assembly 40 comprising a tube 45 and an electronic diagnostic insert 60, which may have the same mass as the weight cartridge 50 disclosed herein, can be determined using the equation $D \geq 0.065(1+M/MT)$. In this equation, M is the mass of the golf club head 10, L is the length of the electronic diagnostic insert 60, MT is the mass of the electronic diagnostic insert 60, the distance from the midpoint of the length L to a center of gravity of the electronic diagnostic insert 60 when the electronic diagnostic insert 60 is disposed within the tube 40 such that the high density end 62 is closer to the sole 30 may be defined as 1/2D, and D is the total center of gravity distance change for the electronic diagnostic insert 60 when its orientation is changed within the tube 40 by being flipped.

Figure 4:
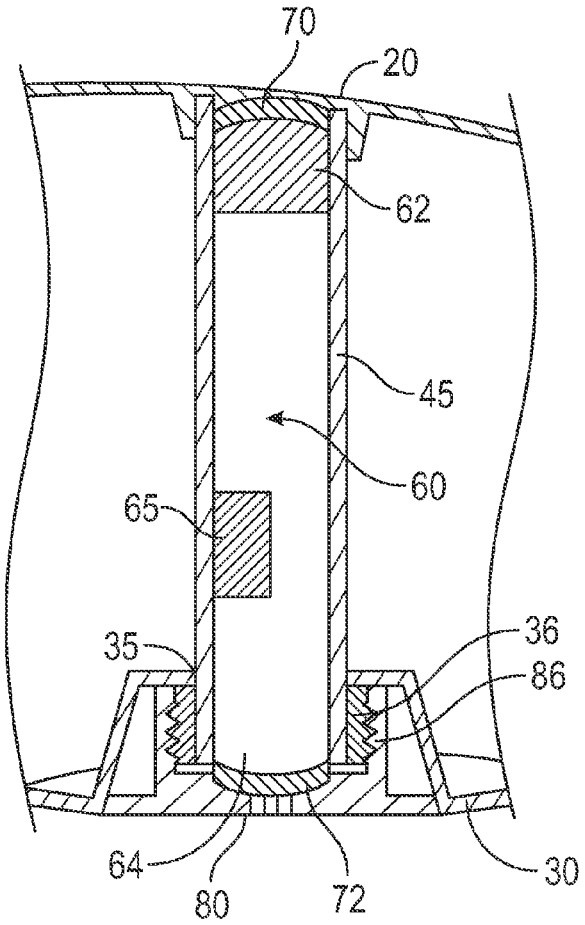
FIG. 4 is a cross-sectional view of the golf club head shown in FIG. 1 along lines 4-4.

As shown in FIG. 4, the electronic diagnostic insert 60 is disposed within the tube 45 between the crown 20 and the sole 30, and preferably separated from each of these parts of the golf club head 10 with one or more cushions 70, 72 composed of a polymeric material that compresses between the electronic diagnostic insert 60 and the interior surfaces of the crown 20 and the sole 30 and reduces the vibration of the electronic diagnostic insert 60 within the tube 45. The cushions 70, 72 also protect the electronic components in the electronic diagnostic insert 60 from damage when the golf club head 10 is in use. These cushions 70, 72 may also be used in connection with the weight cartridge 50 if a golfer wishes to similarly minimize vibrations when using the weight cartridge 50 instead of the electronic diagnostic insert 60. When the golfer has selected which part (weight cartridge 50 or electronic diagnostic insert 60) she wishes to use with the golf club head 10, the part is inserted into the tube 45 via an opening 35 in the sole 30, which is closed with a cover 80. As shown in FIG. 4, each of the opening 35 and the cover 80 comprises mating threads 36, 86 so that the cover 80 may easily be removed and replaced on the sole 30.

The preferred embodiment also includes one or more weight screws 90 sized to fit within and completely close one or both of the weight ports 32, 34 of the golf club head 10. These weight screws 90 may be replaced with, or include, one or more electronic devices that function in the same or similar ways as the electronic diagnostic insert 60. If the weight screw 90 is combined with electronic sensors, these sensors may be removably disposed within a recess in the screw 90, such as the counterbore 95 shown in FIG. 5. Alternatively, an electronic device 100 having the same shape and mass as the weight screw but including any of the electronic sensors disclosed herein may be affixed within one or both of the weight ports 32, 34.

Figure 5:
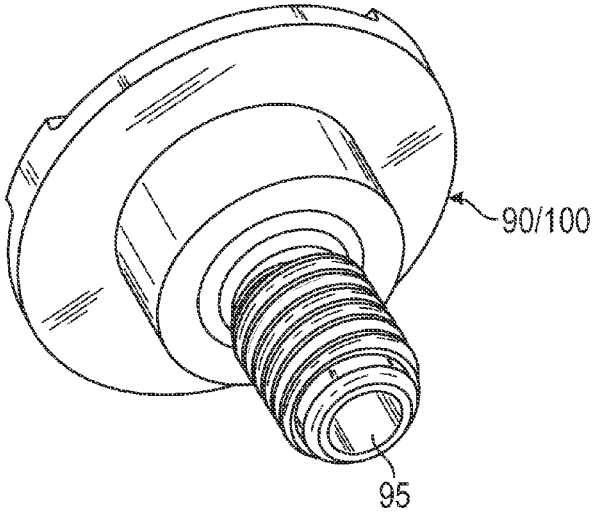
FIG. 5 is a side perspective view of a weight screw according to the present invention or an electronic device shaped like a weight screw.
Figure 6:
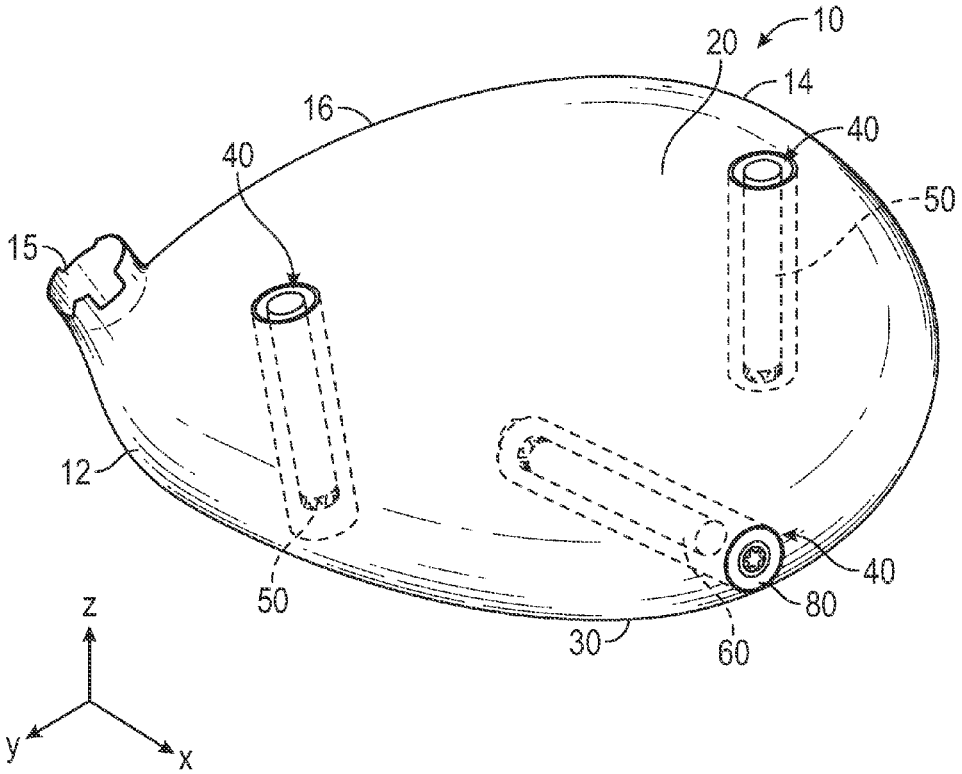
FIG. 6 is a top perspective, partially transparent view of a second embodiment of the golf club head of the present invention.

An alternative embodiment of the present invention is shown in FIG. 6. This embodiment includes three center of gravity height adjustment assemblies 40, a vertical one proximate the heel 12 of the golf club head 10, a vertical one proximate the toe 14, and a third extending parallel with the ground along an X axis extending perpendicular to the face 16. Each of these center of gravity height adjustment assemblies 40 comprises a tube 45 sized to receive a weight cartridge 50 or an electronic diagnostic insert 60, which may be disposed along a vertical Z axis and/or along the horizontal X axis. As shown in FIG. 5, some of the tubes 45 may house a weight insert 50, while the remaining tube 45 may house an electronic diagnostic insert 60 so that a golfer can track his performance during use of the golf club.

Each of the embodiments disclosed herein are described and shown in combination with a driver-type golf club head, but may also be used with other wood-type golf club heads (e.g., fairway woods), irons, hybrids, and putters, which may have any material composition known to a person skilled in the art. They allow a user to adjust the location of the center of gravity along vertical z- and horizontal x- and y-axes, and can disposed anywhere on the body. Also, each of the tubes 45, weight cartridges 50, and electronic diagnostic inserts 60 disclosed herein are shown as having a cylindrical shape with circular cross-sections, but in alternative embodiments may have polygonal cross-sections such that one or more edges of the electronic diagnostic insert 60 or weight cartridge 50 may be made from different materials to allow for greater control over the center of gravity location. Each of the golf club heads disclosed herein preferably are affixed to a shaft composed of any material known to a person skilled in the art, including, but not limited to, graphite composite or steel.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:
a shaft; and
a golf club head comprising:
a face component;
a body comprising a composite crown, a metal sole, a heel side, a toe side, a hollow interior, and a rear side;
a center of gravity,
a mass M,
at least one hollow tube extending through the hollow interior from the sole to the crown;
at least one cushion composed of a polymeric material, and
a first electronic diagnostic insert sized to fit within the hollow tube,
wherein the first electronic diagnostic insert comprises a protective shell, a plurality of sensors, a removable memory card, a first, high density end comprising a first material, a second, low density end comprising a second material having a lower density than the first material, a length L, and a mass MT,
wherein the at least one cushion is disposed within the tube between the first electronic diagnostic insert and the body,
wherein the first electronic diagnostic insert records data about a golfer's swing when a golfer swings the golf club,
wherein the memory card is configured to store the data,
wherein changing the orientation of the first electronic diagnostic insert within the tube changes the location of the golf club head's center of gravity along a vertical Z axis,
wherein the distance from the midpoint of the length L to a center of gravity of the first electronic diagnostic insert when the first electronic diagnostic insert is disposed within the tube such that the high density end is closer to the sole is defined as 1/2D,
wherein the golf club head satisfies the equation $D \geq 0.065(1+M/MT)$, and
wherein D is a total center of gravity distance change for the first electronic diagnostic insert when its orientation is changed within the tube by being flipped.

2. The golf club of claim 1, wherein the at least one hollow tube is accessible via an opening in the sole.

3. The golf club of claim 2, further comprising a removable cover sized to cover the opening in the sole.

4. The golf club of claim 1, wherein the first electronic diagnostic insert is capable of connecting to a wireless network.

5. The golf club of claim 1, further comprising a weight port and at least one removable weight screw sized to fit within the weight port.

6. The golf club of claim 5, further comprising a second electronic diagnostic insert, wherein the second electronic diagnostic insert is sized to fit within the weight port.

7. The golf club of claim 6, wherein the second electronic diagnostic insert has the same shape as the at least one removable weight screw.

8. The golf club of claim 6, wherein the second electronic diagnostic insert has approximately the same mass as the removable weight screw.

9. The golf club of claim 6, wherein the second electronic diagnostic insert records data about a golfer's swing when a golfer swings the golf club.

10. The golf club of claim 1, wherein the golf club head is selected from the group consisting of a wood-type head, a hybrid-type head, an iron-type head, and a putter-type head.

* * * * *